US006360808B1

(12) United States Patent
Twardowska et al.

(10) Patent No.: US 6,360,808 B1
(45) Date of Patent: Mar. 26, 2002

(54) EXOTHERMIC SLEEVE COMPOSITIONS CONTAINING ALUMINUM DROSS

(75) Inventors: Helena Twardowska; Ronald C. Aufderheide, both of Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/596,620

(22) Filed: Jun. 19, 2000

(51) Int. Cl.[7] ..... B22D 23/00; B23K 23/00
(52) U.S. Cl. ..... 164/53; 164/359; 164/360
(58) Field of Search ..... 164/53, 359, 360; 249/197, 198

(56) References Cited

U.S. PATENT DOCUMENTS 3,762,680 A * 10/1973 Whitacre, Jr. et al. ..... 249/197
4,031,046 A * 6/1977 Tisza ..... 260/17.2
4,119,468 A * 10/1978 Wiley ..... 164/53
5,180,759 A 1/1993 Neu et al. ..... 523/141
5,915,450 A 6/1999 Aufderheide et al. ..... 164/53

* cited by examiner

*Primary Examiner*—Kuang Y. Lin
(74) *Attorney, Agent, or Firm*—David L. Hedden

(57) ABSTRACT

The invention relates to exothermic sleeve compositions comprising (a) an oxidizable metal where the oxidizable metal comprises aluminum dross, and (b) an oxidizing agent capable of generating an exothermic reaction. The invention also relates to sleeve mixes prepared with the sleeve compositions, the use of the sleeve composition to prepare sleeves, the sleeves prepared with the sleeve compositions and the use of the sleeves to prepare metal castings.

19 Claims, No Drawings

EXOTHERMIC SLEEVE COMPOSITIONS CONTAINING ALUMINUM DROSS

FIELD OF THE INVENTION

The invention relates to exothermic sleeve compositions comprising (a) an oxidizable metal where the oxidizable metal comprises aluminum dross, and (b) an oxidizing agent capable of generating an exothermic reaction. The invention also relates to sleeve mixes prepared with the sleeve compositions, the use of the sleeve composition to prepare sleeves, the sleeves prepared with the sleeve compositions and the use of the sleeves to prepare metal castings.

BACKGROUND OF THE INVENTION

A casting assembly typically consists of a pouring cup, a gating system (including downsprue, choke, and runner), riser, sleeve, mold, core, and other components. To produce a metal casting, metal is poured into the pouring cup of the casting assembly and passes through the gating system to the mold and/or core assembly where it cools and solidifies. The metal part is then removed by separating it from the core and/or mold assembly.

Risers or feeders are reservoirs that contain excess molten metal. The excess molten metal is needed to compensate for contractions or voids of metal that occur during the casting process. Metal from the riser fills such voids in the casting when the casting metal contracts as it cools. Thus, the metal from the riser needs to remain in a liquid state for a longer period of time, so it can provide metal to the casting as it cools and solidifies. Sleeves are used to surround or encapsulate the riser and other parts of the casting assembly in order to keep the molten metal in the riser hot and maintain it in the liquid state for a longer time.

In order to serve their function, sleeves have exothermic and/or insulating properties. Exothermic sleeves function by liberating heat. This liberated heat satisfies some or all of the specific heat requirements of the riser and limits the temperature loss of the molten metal in the riser, thereby keeping the metal hotter and liquid longer. Insulating sleeves, on the other hand, maintain the heat of the molten metal in the riser by insulating it from the surrounding mold assembly.

Typical exothermic sleeve formulations contain aluminum as a fuel, metal oxides and/or nitrates as oxidizers, and fluoride containing compounds as fluxing agents. Fluoride compounds can be organic, such as fluorocarbon polymers (U.S. Pat. No. 5,180,759) or inorganic, for example sodium fluoride, aluminum fluoride, potassium fluoride, and sodium aluminum fluoride. These fluxing agents reduce the time it takes the exothermic sleeve to ignite and improve the propagation of the exothermic reaction.

However, high fluoride levels in the sleeve can cause fish eye defects in ductile iron castings. Therefore, it is desirable to keep the fluoride level extremely low, while still maintaining a fast exotherm in the sleeve.

U.S. Pat. No. 5,180,759 discloses that the fluoride level of the exothermic sleeve mix can be kept low by using organic fluorine compounds such as Teflon. The claims of the patent suggest that fluoride amounts as low as 0.05% fluoride are effective. However, the examples in the patent do not show polytetrafluoroethylene (PTFE) levels below 1.5% as effective in promoting the exothermic reaction. This level of PTFE corresponds to a fluoride level of 1.12%, which is much higher than the 0.05% level set forth in the claims.

SUMMARY OF THE INVENTION

The invention relates to an exothermic sleeve mix comprising:

(a) an oxidizable metal where the oxidizable metal comprises aluminum dross, and (b) an oxidizing agent capable of generating an exothermic reaction.

This invention differs from the prior art because fluorine compounds typically used as fluxing agents in exothermic sleeve mixes are not required. Instead, a source of fluorine is derived from aluminum dross, which is a by-product of the manufacture of aluminum metal. Aluminum dross contains fluoride as a minor constituent. Aluminum dross has the fluoride intimately mixed and melted with aluminum, other oxidizable metals such as magnesium, silicon and aluminum oxide. Therefore, it provides a very efficient, fast igniting, and good propagating exothermic reaction. Exothermic sleeves containing aluminum dross, fine aluminum powder, potassium nitrate, and iron oxide are particularly efficient as riser sleeves in the casting of ductile iron. The use of aluminum dross with the oxidizing metal reduces the fluoride content needed in exothermic riser sleeves to achieve faster ignition and effective propagation of the exothermic reaction. Consequently, the likelihood of producing castings with "fish eye" defects, particularly ductile iron castings, is reduced.

In most cases, the amount of fluoride in the exothermic sleeve composition can be reduced by as much as 10–20 times compared to existing commercial formulations, while still maintaining a rapid exothermic reaction. Thus, the amount of fluoride in the sleeve mix is reduced to very low levels, e.g. 0.1–0.5 weight percent, based on the weight of the sleeve composition. Although the tested formulations were designed specifically for ductile iron, the sleeve mixes can be used to make sleeves for casting other metals.

DEFINITIONS AND ABBREVIATIONS

The following definitions and abbreviations are stipulated:

Casting assembly—assembly of casting components such as pouring cup, gating system (downsprue, runner, choke), molds, core, riser, sleeve, etc., which are used to make a metal casting.

ISOCURE® cold-box binder—a two part polyurethane-forming cold-box binder where the Part I is a phenolic resin similar to that described in U.S. Pat. No. 3,485,797. The resin is dissolved in a blend of aromatic, ester, and aliphatic solvents, and a silane. Part II is the polyisocyanate component, and comprises a polymethylene polyphenyl isocyanate, a solvent blend consisting primarily of aromatic solvents and a minor amount of aliphatic solvents, and a benchlife extender. The weight ratio of Part I to Part II is about 55:45.

Exothermic sleeve—a sleeve that has exothermic properties compared to the mold/core assembly in which it is used.

Gating system—system through which metal is directed from the pouring cup to the mold and/or core assembly. Components of the gating system include the downsprue, runners, choke, etc.

Handleable—the ability of a sleeve to be transported from one place to another without sagging or breaking.

Microspheres—alumino-silicate hollow spheres such as those described in WO 97/35677.

Mold assembly—an assembly of molds and/or cores made from a foundry aggregate (typically sand) and a foundry binder, which is placed in a casting assembly to provide a shape for the casting.

Pattern—a shape used to make a sleeve.

Riser—cavity connected to a mold or casting cavity of the casting assembly which acts as a reservoir for excess molten metal to prevent cavities in the casting as it contracts on solidification.

Sleeve—any moldable shape having exothermic and/or insulating properties made from a sleeve composition that covers, in whole or part, any component of the casting assembly.

US Standard Screen Test—test to determine particle size distribution using set of sieves 8" diameter and aperture sizes from 4 inches to 500 mesh.

BEST MODE AND OTHER MODES

The exothermic sleeve composition comprises (a) aluminum dross and (b) an oxidizing agent. The sleeve compositions are used to make sleeve mixes that contain (1) an exothermic sleeve composition, and (2) an effective amount of a chemically reactive inorganic or organic binder. The sleeve mix is shaped and cured by contacting the sleeve with an effective amount of a curing catalyst.

Aluminum dross is produced as a by-product during the processing of aluminum metal, and, as such, has a variable composition. The major components of a typical aluminum dross suitable for use in this invention are described in Table I that follows, where the weight percents are based upon the total weight of the aluminum dross composition.

TABLE I (Components of Aluminum Dross)

| Component | Weight Percent |
|---|---|
| Aluminum metal | 5–35 |
| Aluminum oxide | 30–50 |
| Total magnesium | 3–5 |
| Total silicon | 3–5 |
| Total zinc | 0–1 |
| Total copper | 0–1 |
| Nitrogen | 1–4 |
| Chloride | 0–2 |
| Fluoride | 1–15, preferably 1–4 |

The amount of fluoride in the aluminum dross ranges from 0.5 to 15 weight percent, preferably 1 to 4 weight percent, and most preferably 1–2 weight percent, where the weight percent is based upon the total weight of the aluminum dross. The amount of aluminum dross used in the sleeve formulation depends upon the amount of fluoride in s the aluminum dross. The amount of aluminum dross used is an amount that provides an average of about 0.1 to about 1.0 weight percent of fluoride, preferably from about 0.1 to about 0.5 weight percent fluoride, where the weight percent is based on the total weight of the sleeve composition.

Typically, aluminum dross is used in amounts of about 5 to 30 weight percent, preferably 10 to 20 weight percent, in the exothermic sleeve mix, where the weight percent is based upon the total weight of the exothermic sleeve mix. The use of this amount of aluminum dross enables the formulator to decrease the amount of fluoride used in the exothermic sleeve to about 6–10 times below the normal level used with inorganic fluoride fluxing agents. Thus, the level of fluoride can be reduced to levels of 0.1 to 0.5 weight percent, based on the weight of the sleeve composition. The particle size of the aluminum dross is not critical, but should be comparable to other components to ensure efficient mixing with other components. However, typically aluminum dross is used such that 100% passes through a 20-mesh screen, preferably 100% passes through a 40-mesh screen.

The aluminum dross is typically used with traditional oxidizable metals. Typically it is used is with aluminum as a pure metal, or as an alloy with magnesium, silicon, or copper. The weight ratio of aluminum dross to other oxidizable metals is typically from 1:1 to 1:5, preferably from 1:2 to 1:3.

The oxidizing agent used for the exothermic sleeve includes iron oxide, manganese oxide, nitrates, potassium permanganate, etc. Oxides do not need to be present at stoichiometric levels to satisfy the aluminum component since the riser sleeves and molds in which they are contained are permeable. Thus, oxygen from the oxidizing agents is supplemented by atmospheric oxygen when the aluminum fuel is burned. Typically the weight ratio of total aluminum to oxidizing agent is from about 10:1 to about 1:1, preferably about 5:1 to about 1.5:1.

Depending upon the degree of exothermic properties wanted in the sleeve, the amount of total aluminum in the sleeve composition will range from 5 weight percent to 45 weight percent, typically 20 weight percent to 35 weight percent, based upon the weight of the sleeve composition.

Insulating materials can be added to the sleeve composition. Such materials include refractory materials (e. g. magnesia, alumina, sand, and aluminosilicate), hollow microspheres, and fibers. The amount of insulating material in the sleeve composition ranges from 30 weight percent to 85 weight percent, typically 30 weight percent to 70 weight percent, where the weight percent is based upon the weight of the sleeve composition. Preferably used as the insulating material are hollow aluminosilicate microspheres such as those described in WO 97/35677, which is hereby incorporated by reference.

The sleeve mixes can also contain refractories such as silica, sand, magnesia, alumina, olivine, chromite, aluminosilicate, and silicon carbide among others. These refractories are preferably used in amounts less than 60 weight percent based upon the weight of the sleeve composition, more preferably less than 25 weight percent based upon the weight of the sleeve composition.

In addition, the sleeve composition may contain fillers, and additives. Although not necessarily preferred, other fluxes, such as cryolite ($Na_3AlF_6$), potassium aluminum tetrafluoride, potassium aluminum hexafluoride, and fluxes having a low melting point, such as, lithium flux, glass microspheres, and soda-lime glass can be included in exothermic sleeve compositions.

The sleeve compositions are mixed with chemical binders to form a sleeve mix. Any inorganic or organic foundry binder, that sufficiently holds the sleeve mix together in the shape of a sleeve and polymerizes in the presence of a curing catalyst, will work. Examples of such binders include inorganic binders such as sodium silicate binders cured with carbon dioxide (see U.S. Pat. No. 4,985,489 which is hereby incorporated into this disclosure by reference), and organic binders such as phenolic resins, phenolic urethane binders, furan binders, alkaline phenolic resole binders (see U.S. Pat. No. 4,750,716 which is hereby incorporated by reference), and epoxy-acrylic binders among others. Preferred binders include epoxy-acrylic binders sold by Ashland Inc. under the ISOSET® trademark. The epoxy-acrylic binders, cured with sulfur dioxide in the presence of an oxidizing agent, are described in U.S. Pat. No. 4,526,219, which is hereby incorporated into this disclosure by reference. Most preferred as the binder are amine curable phenolic urethane binders, are described in U.S. Pat. No. 3,485,497, U.S. Pat. Nos. 3,409,579, and 3,676,3923, which are hereby incorporated into this disclosure by reference. These binders are based on a two-part system, one part being a phenolic resin component and the other part being a polyisocyanate component.

The amount of binder needed is an effective amount to maintain the shape of the sleeve and allow for effective curing, i.e. which will produce a sleeve which can be handled or self-supported after curing. An effective amount of binder is greater than about 4 weight percent, based upon the weight of the sleeve composition. Preferably, the amount of binder ranges from about 5 weight percent to about 15 weight percent, more preferably from about 6 weight percent to about 12 weight percent.

Curing the sleeve by the no-bake process takes place by mixing a liquid curing catalyst with the sleeve mix, shaping the sleeve mix containing the catalyst, and allowing the sleeve shape to cure, typically at ambient temperature without the addition of heat. The preferred liquid curing catalyst is a tertiary amine and the preferred no-bake curing process is described in U.S. Pat. No. 3,485,797, which is hereby incorporated by reference into this disclosure. Specific examples of such liquid curing catalysts include 4-alkyl pyridines wherein the alkyl group has from one to four carbon atoms, isoquinoline, arylpyridines such as phenyl pyridine, pyridine, acridine, 2-methoxypyridine, pyridazine, 3-chloro pyridine, quinoline, N-methyl imidazole, N-ethyl imidazole, 4,4'-dipyridine, 4-phenylpropylpyridine, 1-methylbenzimidazole, and 1,4-thiazine.

Curing the sleeve by the cold-box process takes place by blowing or ramming the sleeve mix into a pattern and contacting the sleeve with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For example, an amine vapor/gas mixture is used with phenolic-urethane resins. Sulfur dioxide (in conjunction with an oxidizing agent) is used with an epoxy-acrylic resin. Carbon dioxide (see U.S. Pat. No. 4,985,489, which is hereby incorporated by reference) or methyl esters (see U.S. Pat. No. 4,750,716 which is hereby incorporated into this disclosure by reference) are used with alkaline phenolic resole resins.

Preferably sleeves are prepared by a cold-box process with a phenolic urethane binder by passing a tertiary amine gas, such a triethylamine, through the molded sleeve mix in the manner as described in U.S. Pat. No. 3,409,579; or with an epoxy-acrylic-polyisocyanate binder cured with a tertiary amine gas and by a free radical mechanism as described in U.S. Pat. No. 5,880,175, which is hereby incorporated by reference. Typical gassing times are from 0.5 to 3.0 seconds, preferably from 0.5 to 2.0 seconds. Purge times are from 1.0 to 60 seconds, preferably from 1.0 to 10 seconds.

EXAMPLES

All lettered Examples are controls that use formulations without aluminum dross. All parts are by weight and all percentages are weight percentages based upon the weight of the sleeve composition unless otherwise specified. The examples merely illustrate the invention and are not intended to limit its scope.

Exothermic sleeves were prepared using cold-box technology with a phenolic-urethane binder by mixing the sleeve compositions and binder in a Hobart N-50 mixer for about 2–4 minutes. The exothermic compositions contained aluminosilicate microspheres, fine aluminum powder, aluminum dross, iron oxide and potassium nitrate. These components were mixed with an ISOCURE® Part I and Part II binder and then cured with triethylamine catalyst (TEA) using a conventional cold-box process. The amount of binder used in all cases was 8.8 weight percent based upon the weight of the sleeve composition.

The sleeves were then tested for ignition characteristics, propagation and casting performance in a ductile iron test casting. Exothermic 2"×3"×"⅜" (diameter/height/thickness) insertable sleeves were tested on an impeller casting that weighs about 6 kilograms. Evaluation of the castings included the safety margin of the riser, feeding pattern, and an analysis of the surface finish of the casting. Several formulations were tested, using different aluminum dross materials, different oxidizers and fluxes. The results are summarized in the attached Tables and Figures with photos.

Specific examples of the compositions tested (weight %) are shown below in Examples 1–4. Examples 1 and 2 contain slightly different dross materials. The amount of aluminum in the aluminum dross in Example 1 is about 20–22% by weight aluminum, while the amount in Example 2 is about 8–10% aluminum. Exothermic mixes were also prepared with 1 and 2% Teflon for comparison (Examples A and B).

| | Example Number | | | | | | |
|---|---|---|---|---|---|---|---|
| Component | 1 | 2 | 3 | 4 | A | B | C |
| Microspheres SGT | 35 | 35 | 39 | 50 | 53 | 52 | 51 |
| Fine Al 787 | 28 | 28 | 28 | 28 | 28 | 28 | 28 |
| Al dross | 15 | 15 | 15 | 0 | 0 | 0 | 0 |
| Black iron oxide | 10 | 10 | 10 | 10 | 10 | 10 | 10 |
| Potassium nitrate | 8 | 8 | 8 | 8 | 8 | 8 | 8 |
| Lithium flux | 4 | 4 | 0 | 4 | 0 | 0 | 0 |
| Teflon K-10 | 0 | 0 | 0 | 0 | 1 | 2 | 0 |
| Cryolite | 0 | 0 | 0 | 0 | 0 | 0 | 3 |
| Fluoride content | 0.3 | 0.27 | 0.3 | 0 | 0.75 | 1.5 | 1.6 |
| Total Al content | 31 | 30 | 31 | 28 | 28 | 28 | 28 |

Ignition tests were performed using cylindrical samples measuring ⅞" in diameter and ⅞" high. Optical pyrometer was used to determine time to ignition and duration of exotherm. The ignition test consists of placing the sample in a furnace at 1000° C. and recording the time (in seconds) it takes for the exotherm to ignite.

Propagation tests were conducted with 1"×0.5"×4" bars. The propagation test consists of igniting one end of the bar with a 750° C. heat source. As soon as the sample ignites, it is removed from the heat source and the exotherm is allowed to bum on its own. The time (in seconds) it takes the exotherm to travel across the bar and the distance (in inches) the exotherm travels across the bar are recorded.

The results of the ignition tests and propagation tests are summarized in the Table I.

TABLE I (Results of Ignition Test)

| Composition | Time to ignite (in seconds) |
|---|---|
| Example 1 | 53 |
| Example 2 | 46 |
| Example 3 | |
| Example 4 | |
| Example A | 47 |

TABLE I-continued (Results of Ignition Test)

| Composition | Time to ignite (in seconds) |
|---|---|
| Example B | 25 |
| Example C | 31 |

TABLE II (Results of Propagation Test)

| | Duration of exotherm | Time to ignite | Distance | Time to propagate |
|---|---|---|---|---|
| Example 1 | 117 | 100 | 4 | 168 |
| Example 2 | 97 | 108 | 4 | 175 |
| Example 3 | | 121 | 4 | 197 |
| Example 4 | | 290 | 2.5 | Incomplete |
| Example A | 95 | 265 | 2 | Incomplete |
| Example B | 128 | 218 | 3.5 | Incomplete |
| Example C | 92 | 60 | 4 | 90 |

Tables I and II show that formulations containing aluminum dross have similar ignition test parameters as samples with 1% Teflon (Examples A and B), but much better propagation, even though the fluoride concentration in the samples containing Al dross is 2 to 3 times lower than in sample with 1% Teflon.

The safety margin of the sleeves was also measured. Table IV shows the safety margins of the sleeves prepared with sleeve compositions 1–6 containing aluminum dross and sleeve compositions A and B that do not contain aluminum dross, but contain Teflon.

TABLE III (Safety Margin of Exothermic Formulations with Ductile Iron Impeller Casting)[1]

| Composition | Primary Shrinkage | Secondary Shrinkage | |
|---|---|---|---|
| Example 1 | 2.2 | 1.7 | |
| Example 2 | 2.4 | 1.2 | |
| Example 3 | 2.0 | 1.5 | |
| Example 4 | 1.8 | 0.8 | |
| Example A | 1.3 | 0.8 | |
| Example B | 1.6 | 0.6 | |
| Example C | 2.2 | 1.8 | from the top |

[1]The higher the number the better the performance.

Table III shows the formulations containing aluminum dross give better safety margins than the previous art with low fluoride concentration. Those formulations match the performance of the previous art with high fluoride content. The presence of a flux (Example 3) having low melting point at 700° C. was not essential in this test, although it could be useful in some applications.

It is also important to note that exothermic sleeves containing aluminum dross feed from the top, which is a more efficient feeding pattern and sometimes allows the use of a smaller riser size. These formulations can also be used for mini-risers. Mini-risers are very small risers that feed metal very efficiently, resulting in small amount of waste metal. This is achieved with highly exothermic sleeves having large thickness. Presently such sleeves are made of sand with a large amount of aluminum, sodium nitrate and cryolite. They are very expensive because of their high weight.

What is claimed is:

1. An exothermic sleeve composition comprising:

(a) an oxidizable metal where the oxidizable metal comprises aluminum dross, wherein the aluminum dross comprises from 0.5 to 15 weight percent fluoride, where the weight percent is based upon the total weight of the aluminum dross, and (b) an effective amount of an oxidizing agent capable of generating an exothermic reaction.

2. The sleeve composition of claim 1 wherein the aluminum dross comprises 5 to 35 weight percent aluminum metal, 30 to 50 weight percent aluminum oxide, 3 to 5 weight percent magnesium, 3 to 5 weight percent silicon, 0 to 1 weight percent zinc, 0 to 1 weight percent copper, 1 to 4 weight percent nitrogen, 0 to 2 weight percent chloride, and 1 to 4 weight percent fluoride.

3. The sleeve composition of claim 2 wherein aluminum dross used in the sleeve composition is an amount that provides an average of about 0.1 to about 1.0 weight percent of fluoride, where the weight percent is based on the total weight of the sleeve composition.

4. The sleeve composition of claim 3 wherein the sleeve composition includes aluminum as an oxidizable metal.

5. The sleeve composition of claim 4 wherein the ratio of aluminum dross to aluminum is from about 1:1 to about 1:5.

6. The composition of claim 5 wherein the aluminum dross comprises a particle distribution such that 100 weight percent of the aluminum passes through a 40 mesh as determined by the US Standard Screen Test.

7. The composition of claim 6 wherein the oxidizing agent is iron oxide.

8. The composition of claim 7 wherein the aluminum dross comprises at least 5 to 45 weight percent of the sleeve composition.

9. The sleeve composition of claim 8 wherein the sleeve composition contains from 30 weight percent to 80 weight percent of hollow alumina microspheres, where said weight is based upon the total weight of the sleeve composition.

10. The sleeve composition of claim 9 wherein the sleeve composition contains sand as a refractory.

11. A sleeve mix comprising the sleeve composition of claim 1,2,3,4,5,6,7,8,9, or 10, and an effective binding amount of an organic foundry binder.

12. A cold-box process for making an exothermic sleeve comprising:

(A) introducing the sleeve mix of claim 11 into a sleeve pattern to prepare an uncured sleeve;

(B) contacting said uncured sleeve prepared by (A) with a vaporous curing catalyst;

(C) allowing said sleeve resulting from (B) to cure until said sleeve becomes handleable; and (E) removing said sleeve from the pattern.

13. The process of claim 12 wherein the binder is selected from the group consisting of phenolic urethane binders and epoxy-acrylic binders.

14. The process of claim 13 wherein the binder level is from about 4 weight percent to about 12 weight percent based upon the weight of the sleeve composition.

15. A sleeve prepared by the process of claim 14.

16. A process for casting a metal part which comprises:

(1) using an exothermic sleeve of claim a mold assembly of a casting assembly;

(2) pouring metal, while in the liquid state, into said casting assembly;

(3) allowing said metal to cool and solidify; and (4) then separating the cast metal part from the casting assembly.

17. A no-bake process for preparing sleeves having exothermic properties that are chemically cured in the presence of a liquid catalyst comprising the steps of:

(A) introducing a mixture of a sleeve mix of claim 11 and a catalytically effective amount of liquid catalyst into a sleeve pattern to form a sleeve;

(B) allowing said sleeve resulting from (A) to cure until said sleeve becomes handleable; and (C) removing said sleeve from the pattern.

18. A sleeve prepared in accordance with claim 17.

19. A process for casting a metal part which comprises:

(1) inserting an exothermic sleeve of claim 18 into a casting assembly;

(2) pouring metal, while in the liquid state, into said casting assembly;

(3) allowing said metal to cool and solidify; and (4) then separating the cast metal part from the casting assembly.

* * * * *